US005913463A

United States Patent [19]

Carr

[11] Patent Number: 5,913,463

[45] Date of Patent: Jun. 22, 1999

[54] THIRD HAND—A CUP HOLDER

[76] Inventor: Michael J. Carr, P.O. Box 1404, West Palm Beach, Fla. 33402

[21] Appl. No.: 08/934,059

[22] Filed: Sep. 19, 1997

[51] Int. Cl.[6] ..... A45F 3/16; A45F 5/00

[52] U.S. Cl. ..... 224/148.4; 224/148.1; 224/148.7; 224/257; 224/270

[58] Field of Search ..... 224/148.1–148.7, 224/257, 258, 270

[56] References Cited

U.S. PATENT DOCUMENTS

| | | | |
|---|---|---|---|
| 1,109,161 | 9/1914 | Chindgren | 224/148.4 |
| 2,550,554 | 4/1951 | Griffin | 224/148.4 |
| 5,147,079 | 9/1992 | Heather | 224/148 |
| 5,167,354 | 12/1992 | Cohanfard | 224/148 |
| 5,390,838 | 2/1995 | Jafarkhani | 224/148.4 |
| 5,407,110 | 4/1995 | Marsh, Jr. | 224/148 |
| 5,454,497 | 10/1995 | Kettelson | 224/148 |

*Primary Examiner*—David J. Walczak
*Assistant Examiner*—Timothy L. Maust
*Attorney, Agent, or Firm*—Patent & Trademark Services; Thomas Zack; Joseph H. McGlynn

[57] ABSTRACT

A cup holder assembly having an upper user engaging section and a joined lower cup holder section which is offset both horizontally and vertically from the upper section to rest against the chest of the user's body. The upper section has a convex bowed out shape configured to engage the user's upper chest and provide for the offset to the lower joined cup holding section to engage the user's lower chest. Upper section spaced end holes permit the attachment of a through strap for the user to vertically support the holder. The lower holder section has a flat lower outwardly extending container support platform and a separated upper encircling container support ring both of which are joined to a vertical concave back support member which engages the cup.

2 Claims, 3 Drawing Sheets

THIRD HAND— A CUP HOLDER

BACKGROUND OF THE INVENTION

When performing various activities, especially those performed outside the home such as at festivals, fairs, concerts and baseball, football or soccer games, it is often desirable to have a liquid or food container nearby within arms reach to quench ones thirst or hunger. Over the years various types of holders for containers have been developed that can be attached to ones person or clothing. Many have a carrying strap to encircle the waist, torso or a limb of the user while others may be fastened to an item of clothing such as user's belt. In any event, by suspending the container the user is able to use their two free hands thereby letting the holder perform like a "third hand".

If the holder is supported by a strap that abuts a person's body, like their hip, the holder and its container will generally hang straight down and be moved with the movement of the user's body. This may result in excess shaking of the liquid within the container or the possibility that the container will be dislodged from its holder. For carbonated liquid beverages the results are particularly undesirable. The present invention seeks to reduce the amount of shaking applied to a container as the user moves while holding it to the user's upper body by providing for a holder having a lower offset cup holder portion for the beverage cup that allows it to rest upright against the user's chest as described herein.

DESCRIPTION OF THE PRIOR ART

Container holders with straps that permit attachment to a user's body are known. For example, U.S. Pat. No. 5,147,079 to Heather discloses a carrier device for a container having a strap assembly which encircles the container at several spaced positions and a shoulder strap. The Cohanfard patent (U.S. Pat. No. 5,167,354) describes a domed shaped container cover having a strap and a sipping assembly. In the Marsh, Jr. reference (U.S. Pat. No. 5,407,110) a neck strap suspension has a selectively releasable girth strap with container fasteners.

In U.S. Pat. No. 5,454,497 to Kettelson a hanging beverage container carrier has expandable corrugations to accommodate the diameter and longitudinal shape of the container. In contrast to this art and the known prior art, the present invention provides for a container holder having a corded offset section which engages the user's upper body and a vertically and horizontally displaced lower cup holder section resting against the user as more further set forth in this specification.

SUMMARY OF THE INVENTION

This invention relates to a cup holder that can be hung by a cord around back of a user's neck. The holder has an upper corded section and a lower cup holder section which is vertically and horizontally offset therefrom to hold a beverage cup upright. A neck cord permits the upper section to be hung from the neck and rest in an upright position upon the user's chest.

It is the primary object of the present invention to provide for an improved cup holder apparatus.

Another object is to provide for such an apparatus having an upper offset section with means to hang the holder and its carried cup on a user.

These and other objects and advantages of the present invention will become apparent to readers from a consideration of the ensuing description and the accompanying drawings.

DESCRIPTION OF THE PREFERRED EMBODIMENT

Figure 1:
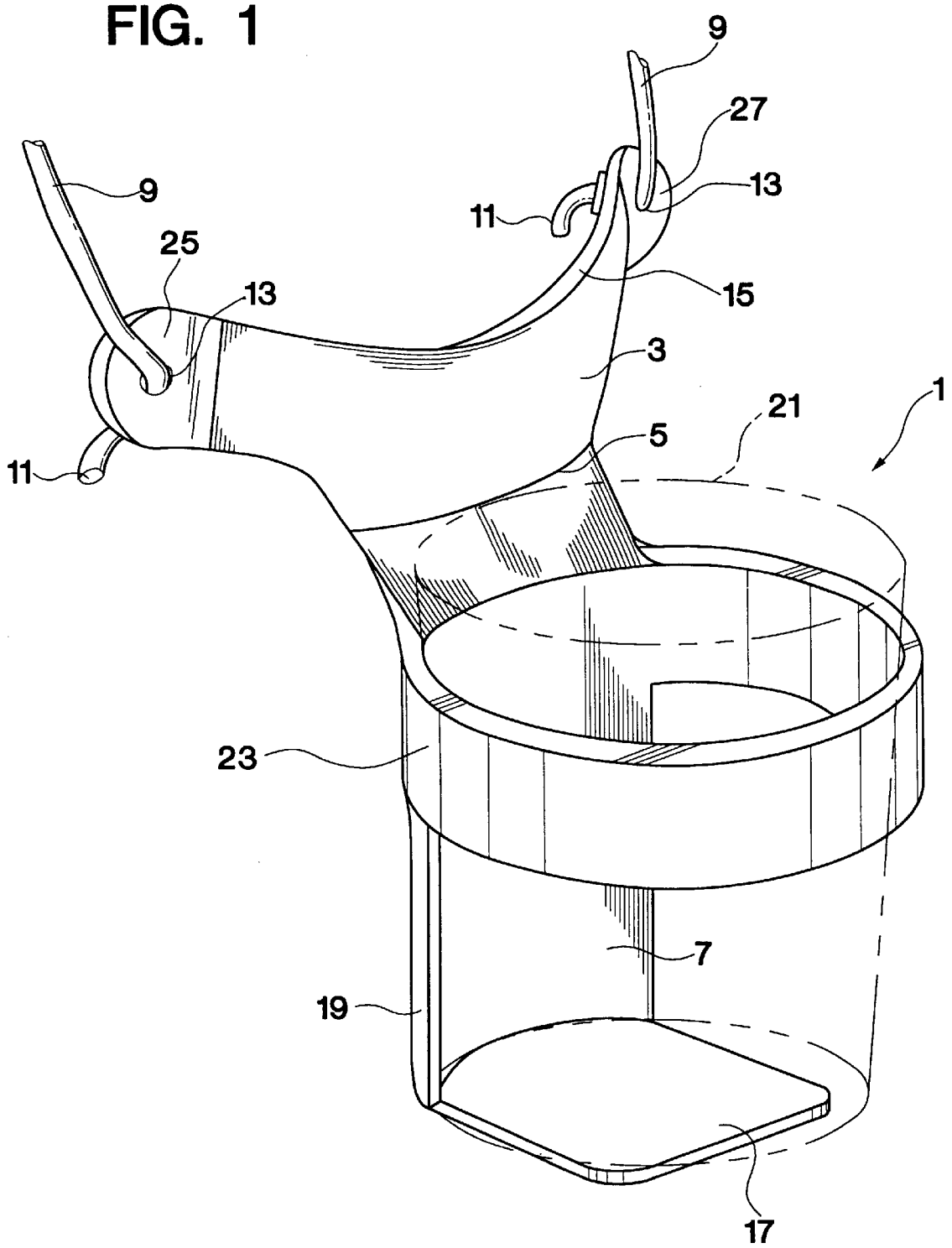
FIG. 1 is a perspective view of the invention's preferred embodiment as seen from one of its front sides.

FIG. 1 is a perspective view of the invention's preferred embodiment as seen from its left front side when mounted on a user (not shown). The cup holder 1 has an upper vertically and horizontally displaced offset section 3 with a joining section 5 to a lower cup holder section 7. Cord 9 has knotted ends 11 that fit through two spaced holes 13 in the upper section 3. This cord hangs around the back of the neck of a user and is used as a cord fastener to vertically support the holder 1 by a user. At the uppermost part of section 3 there is a chest engaging convex bowed out shaped part 15 configured such that its concave side can be placed against the user's chest to allow for the upright positioning of the cup holder when it engages the user. Typically part 15 would rest against a person's body or clothing approximately at the upper chest.

The lower section 7 has a horizontally disposed outwardly extending lower flat cup support platform 17 attached at a right angle to a vertically concave back support member 19 whose concave surface faces towards the side of a held carried cup 21, shown in dotted line format. An encircling circular ring 23, forming another part of the lower holder section, fits almost completely around the upper part of the container and is molded into the upper part of the vertical concave member 19 just below where it joins to the upper section's 5. All of the mentioned holder sections, except for the inserted user neck cord 9, may be molded as one unitary light weight structure. The container itself would be a beverage cup for a liquid or it may contain more solid material such as nuts, snacks, other food items, or any desired material wished to be transported.

Figure 2:
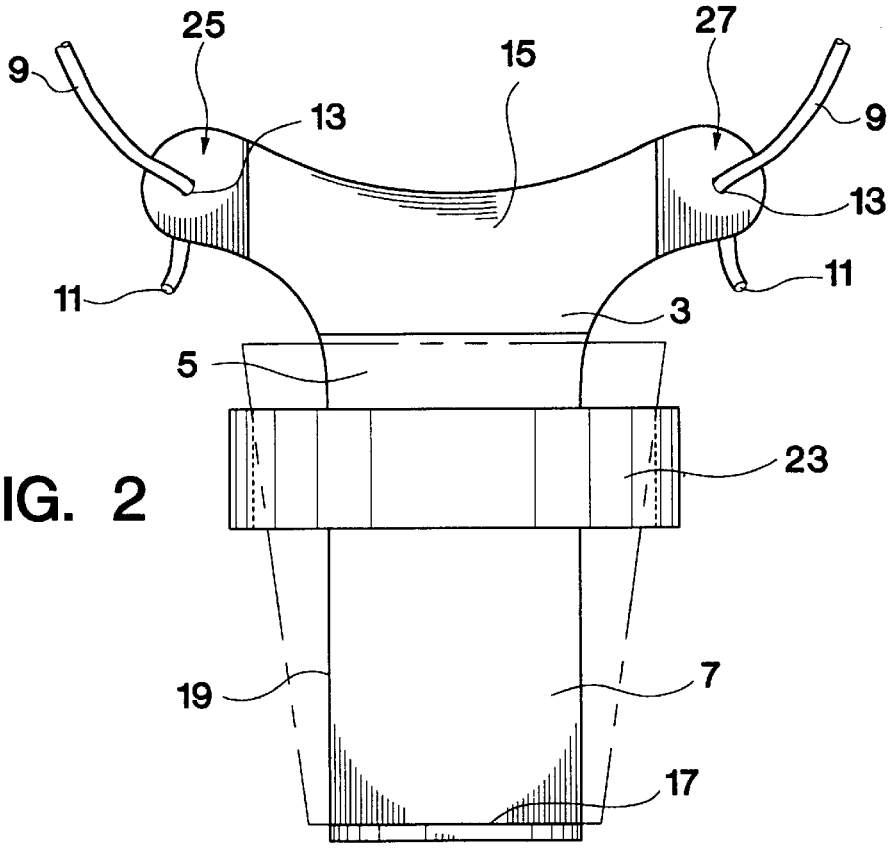
FIG. 2 is a front view of the FIG. 1 embodiment.

FIG. 2 is a front view of the FIG. 1 embodiment with the cord 9 extending a greater length through the holes 13 in the convex bowed out section 15 from the end knots 11 previously described. All other components are as previously described with respect to the FIG. 1 embodiment. The ring cup holder 23 is parallel to the lower cup support platform 17 and extends outwardly on both sides a greater distance. The convex bowed out section 15 has two opposite reduced diameter "ear" shaped parts 25 and 27 in which the cord holes 13 have been bored.

Figure 3:
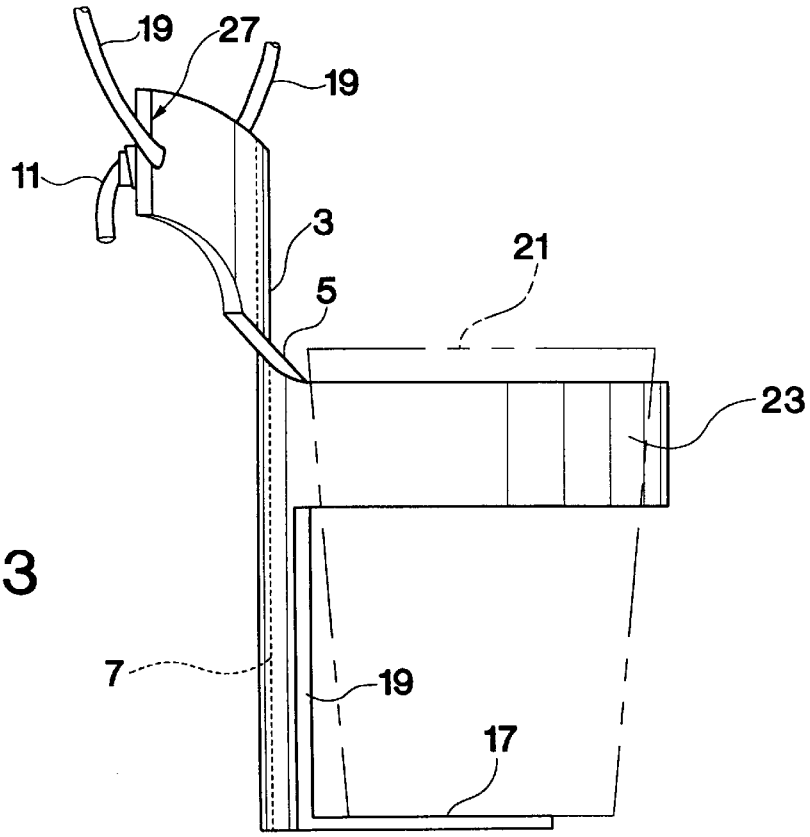
FIG. 3 is a side view of the preferred embodiment.

FIG. 3 shows a side view of the FIG. 2 preferred embodiment. This view shows how the free end diameter of ring 23 extends further out from the rear concave back cup support section 19 than the lower flat cup support platform 17. It also depicts the vertically and horizontally offset sections 5 and 15, especially the more offset pronounced joining section 5, which mount the top of the cup away from the users body. When carried, lower body movements are not directly transmitted to the container due to its position on the upper body. Thus, the offsets permit the container's lower section 7 to be correctly positioned to hold an upright open cup while its uppermost convex bowed out section 15 engages the user's body at its inner facing side of the two ear ends 25 and 27 (latter described as with its flattened parts 29 and 31), having the cord end knots 11.

Figure 4:
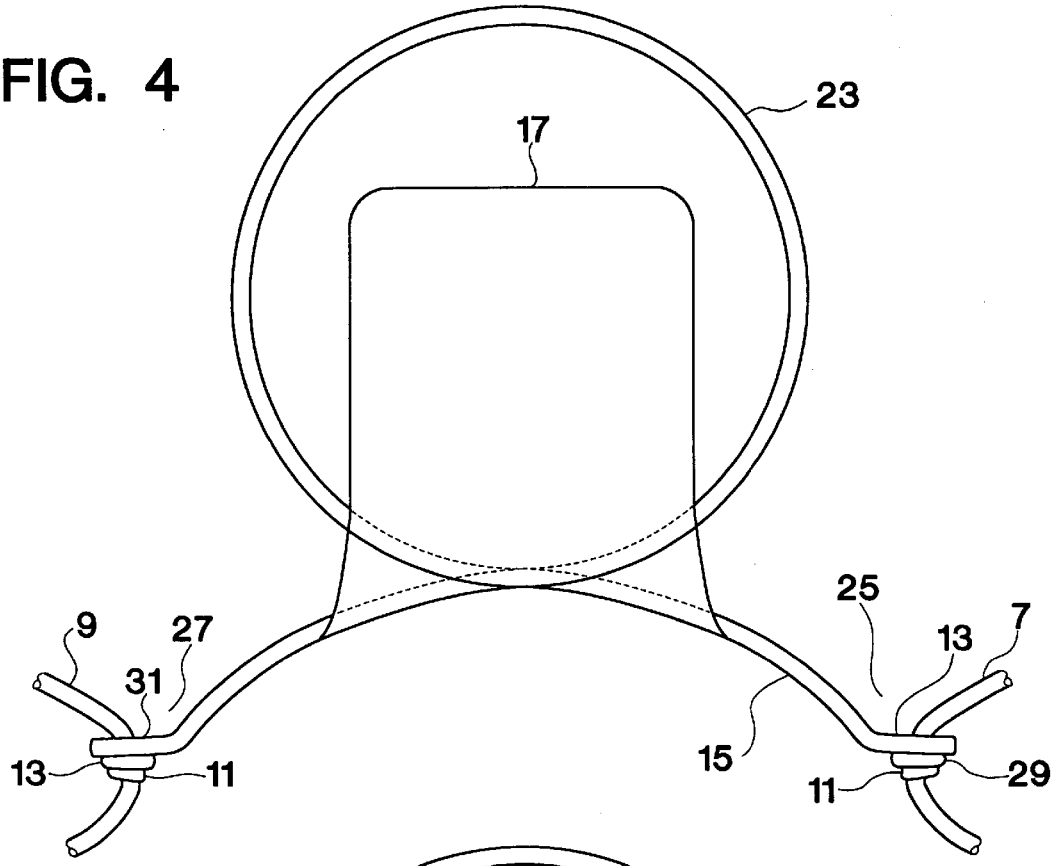
FIG. 4 is a bottom view of the preferred embodiment.

FIG. 4 is a bottom view of the preferred embodiment showing the underside of the generally rectangular lower support cup platform 17 with the higher larger cup ring 23. It also illustrates the convex curvature of the upper user engaging section 15 with its two ear ends 25 and 27 and their respective flatted parts 29 and 31, respectively, through which the two cord holes 13 have been bored.

Figure 5:
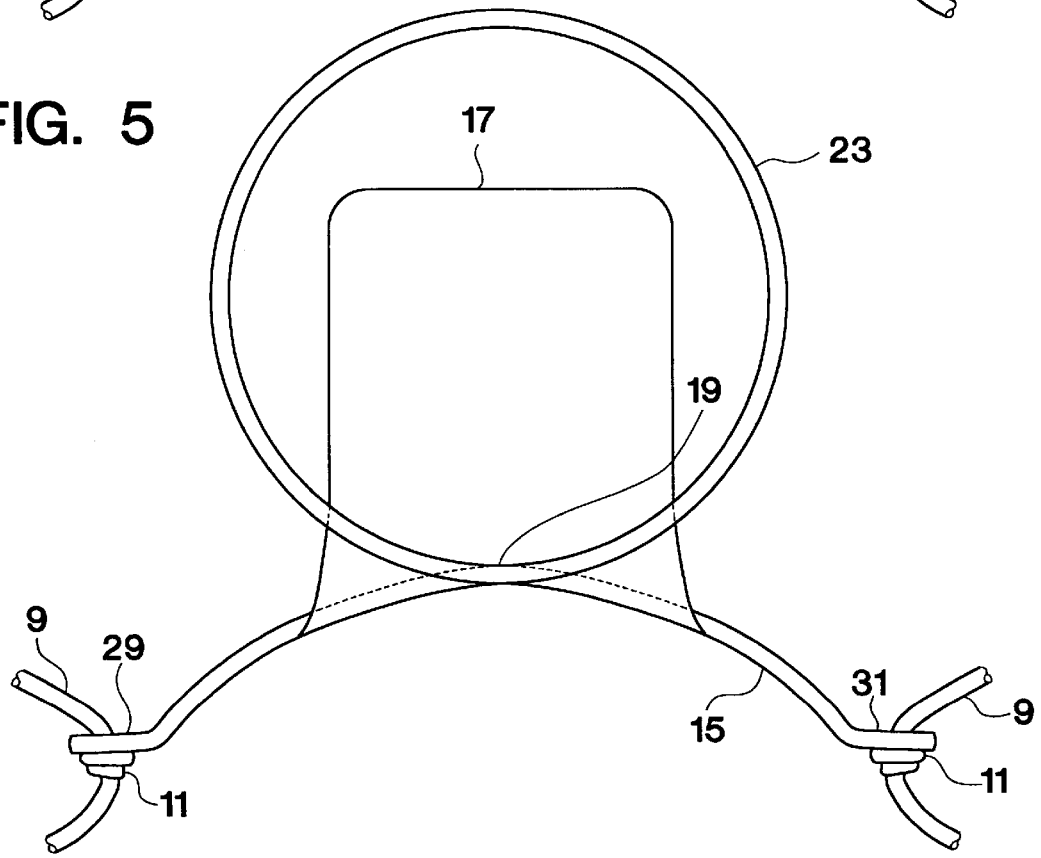
FIG. 5 depicts a top view of the preferred embodiment.

FIG. 5 depicts a top view of the preferred embodiment as is somewhat similar in appearance to FIG. 4. This view more clearly shows the concave curvature of the vertical back cup support section 19 which appears to be a continuation of the circular ring 23 into which it is molded.

The holder 1 can be manufactured of any lightweight, strong weather resistant material such as high impact ABS (Acrylonitrile-butadiene-styrene) plastic or polyethylene plastic material. Injection molding may be used in the manufacturing process to produce one unitary molded structure. Injection molding is a plastic molding process whereby heat softened plastic material is forced under very high pressure into a metal cavity mold, usually aluminum or steel, which is relatively cool.

The inside cavity of the mold is comprised of one or more halves, and is the same desired shape as the product to be formed (in this case the holder). High pressure hydraulics are used to keep the mold components together during the actual injection phase of the molding process. The injected plastic is allowed to cool and harden in the mold. The hydraulics holding the multiple component mold cavity together are released, the molds are separated and the solid formed plastic item is removed. Injection molding can be highly automated process and is capable of producing extremely detailed parts at a very cost effective price. The process should be invaluable in producing this invention's holder cost effectively.

In one embodiment the holder has the following dimensions: ring 23 (1 inch in height and O.D. (outside diameter) of 3.5 inches), curvature of convex part 15 (1inch setback as measured from a straight line joining flatted surfaces 29 and 31), support base 17 (2.5 inches out from vertical back 19 and 2 inches wide), total height of holder (6 inches), diameter of concave vertical support 19(2 inches) and a thickness of about ⅛ inches for the holder. The cord 9 is a braided nylon or worn cotton neck cord. Clearly, other dimensions are possible and other materials may be used for the holder and its cord which could be made of leather. Also, identifying visually pleasing logo or trademark may be placed on the outer free end of ring 23 to identify a desired product or service.

Although the present invention's preferred embodiment and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A cup holder assembly comprising:

a cup holder made of a unitary structure having an upper user engaging bowed out convex curvature section and a joined lower cup holder section with a cup support platform and a spaced upper cup encircling member, said lower section being offset both horizontally and vertically from the upper convex curvature section with said upper convex curvature section being adapted to have its back portion directly resting against a user's chest;

said upper convex curvature section having two opposite ear shaped ends with cord retaining holes in each of the ears to permit the attachment of a cord therein; and a cord fastener mounted in each of the cord retaining holes of said upper convex section to permit the attachment of the assembly to a user, said cord fastener being adapted to vertically support the assembly when worn by a user.

2. The invention as claimed in claim 1, wherein said lower cup section includes a vertically concave support section joining the lower cup support platform to the spaced upper cup encircling member.

* * * * *